US005272973A

United States Patent [19]

Chojnacki

[11] Patent Number: 5,272,973

[45] Date of Patent: Dec. 28, 1993

[54] INKCUP ASSEMBLY AND DRIVE MECHANISM FOR PAD PRINTING MACHINE

[75] Inventor: Andrzej Chojnacki, Alden, N.Y.

[73] Assignee: United Silicone Inc., Alden, N.Y.

[21] Appl. No.: 7,510

[22] Filed: Jan. 22, 1993

[51] Int. Cl.[5] ..... B41K 3/54

[52] U.S. Cl. ..... 101/163; 101/167; 101/44

[58] Field of Search ..... 101/33, 34, 35, 333, 101/327, 41–44, 163, 167

[56] References Cited

U.S. PATENT DOCUMENTS

| | | | |
|---|---|---|---|
| 2,519,894 | 8/1950 | Dohl et al. | 101/235 |
| 4,019,436 | 4/1977 | Handweiler et al. | 101/41 |
| 4,060,031 | 11/1977 | Philipp | 101/41 |
| 4,314,504 | 2/1982 | Combeau | 101/41 |
| 4,365,554 | 12/1982 | Siegal et al. | 101/333 |
| 4,557,195 | 12/1985 | Philipp | 101/163 |
| 4,905,594 | 3/1990 | Philipp | 101/163 |
| 5,003,872 | 4/1991 | Dalferth | 101/163 |

FOREIGN PATENT DOCUMENTS

| | | | |
|---|---|---|---|
| 0136759 | 4/1985 | European Pat. Off. | 101/41 |
| 3335230 | 4/1985 | Fed. Rep. of Germany | 101/41 |
| 527309 | 2/1977 | U.S.S.R. | 101/41 |

*Primary Examiner*—Eugene H. Eickholt

*Attorney, Agent, or Firm*—Hodgson, Russ, Andrews, Woods & Goodyear

[57] ABSTRACT

An inkcup and drive mechanism for a printing machine wherein the inkcup comprises a hollow body for containing a supply of ink and having an open end outlined by a wiping edge, a biasing spring for urging the wiping edge into contact with a surface of a printing plate, and a holder for supporting the biasing spring and engaging the printing plate so that the assembly of hollow body, biasing spring and holder is movable along the printing plate to place the open end of the hollow body into and out of registry with the image for inking the same and so that the biasing spring is entirely within the inkcup and applies force only to the hollow body and to the holder. The printing plate is removable from the machine so that the inkcup is easily manually removable from the machine in a sealed and contained condition. First and second drive mechanisms move the inkcup between inking and standby positions and move the pad between pickup and printing positions in a manner such that the motion imparted to the inkcup and pad is harmonic wherein maximum speed occurs between positions and deceleration to reach zero speed occurs at the desired locations. A fixture receives the printing plate and inkcup as a unit when removed from the machine and restrains the force of the biasing spring to allow manipulative operations on the unit.

30 Claims, 6 Drawing Sheets

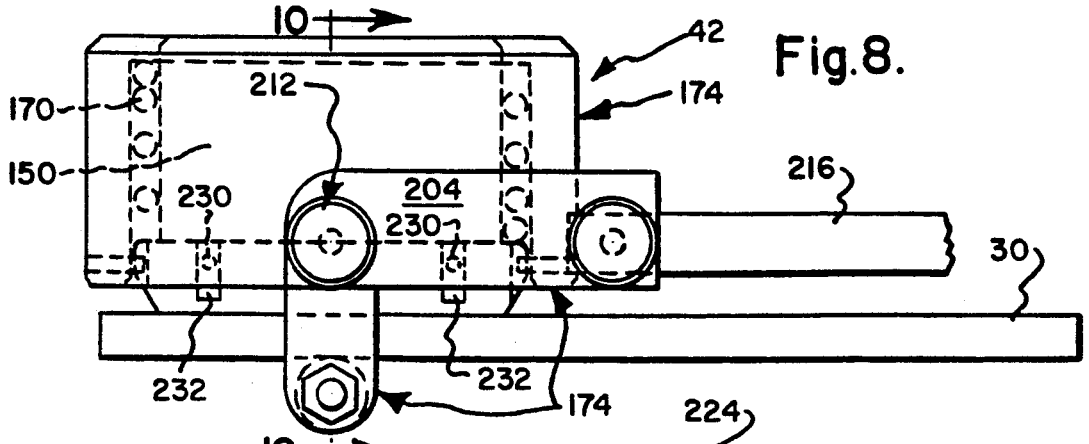
Fig.8.
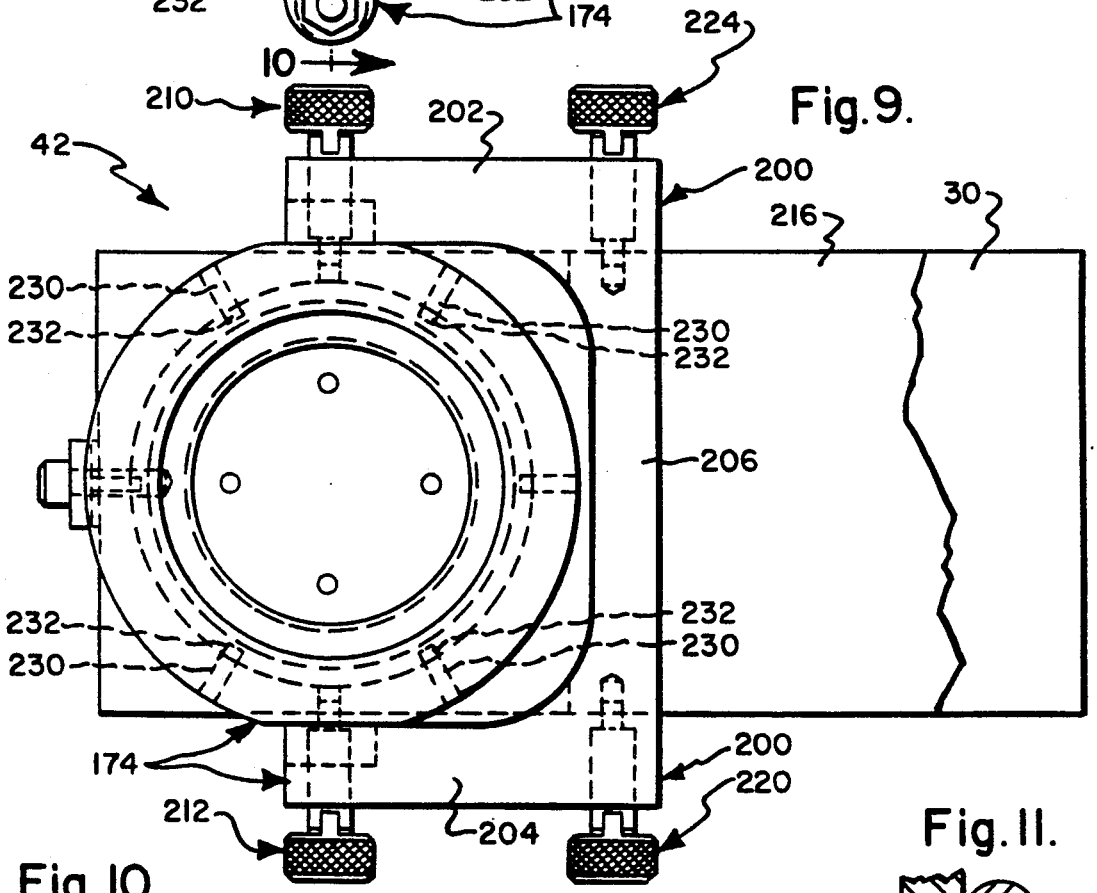
Fig.9.
Fig.10.
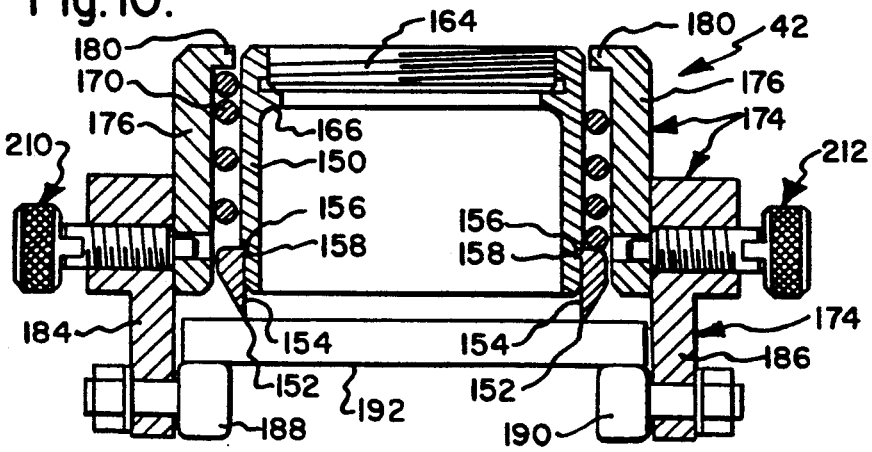
Fig.11.
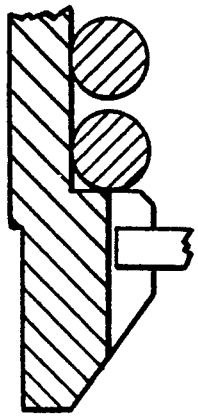

Fig. 12A.
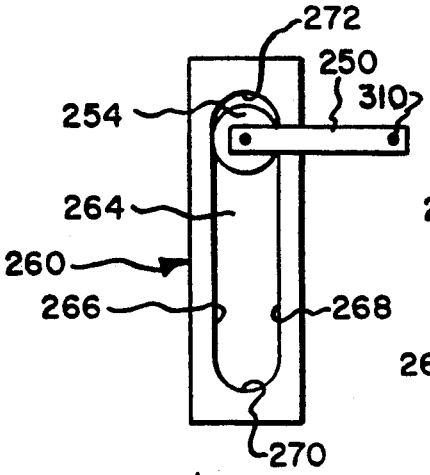
Fig. 12B.
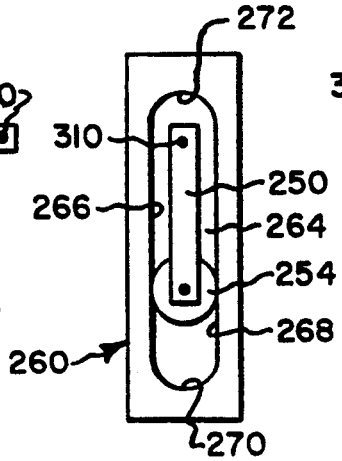
Fig. 12C.
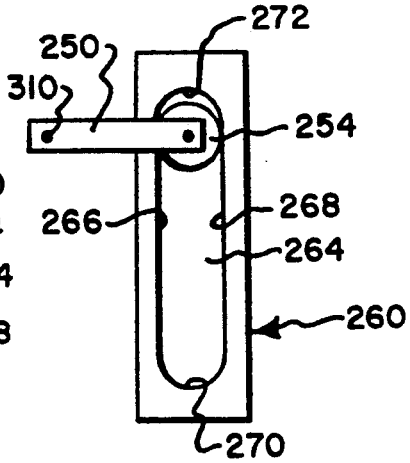
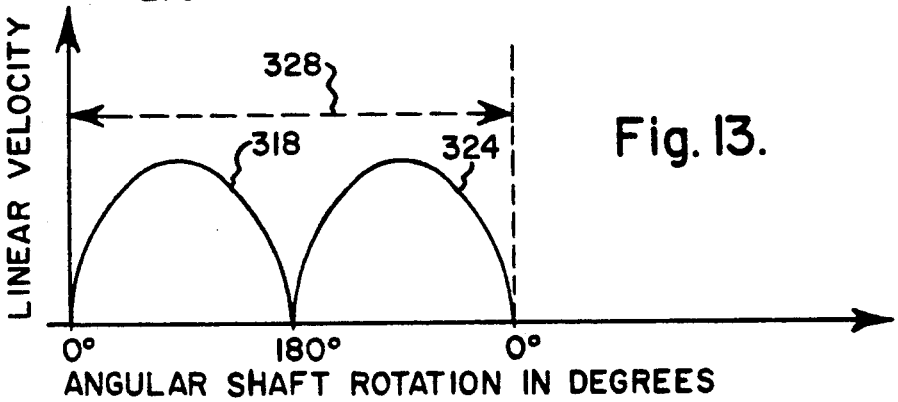
Fig. 13.
Fig. 16.
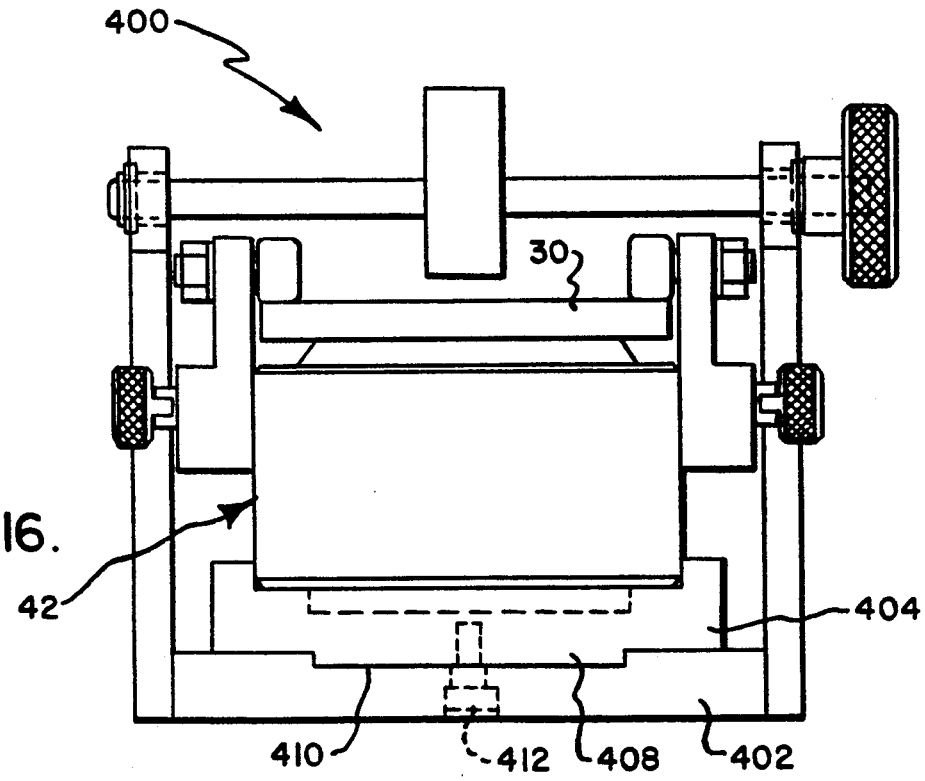

INKCUP ASSEMBLY AND DRIVE MECHANISM FOR PAD PRINTING MACHINE

BACKGROUND OF THE INVENTION

This invention relates generally to the art of printing machines, and more particularly to a new and improved inkcup assembly and drive mechanism for a printing machine.

One area of use of the present invention is in a pad-type printing machine, although the principles of the present invention can be variously applied. In a basic pad-type printing machine, a printing plate or cliche has an operative surface provided with an image to which ink is applied for subsequent transfer of the inked image to an object to be printed. Ink is applied to the image by an inkcup assembly which is moved back and forth along the operative surface of the printing plate into and out of operative registry with the image. The inkcup assembly includes a hollow body containing a supply of ink and having an end face which is pressed by biasing means such as a spring against the operative surface of the printing plate. In synchronism with the afore-mentioned movement of the inkcup assembly, a pad is moved into registry with the inked image and pressed thereon to pick up the inked image and then moved into position for pressing the inked image onto the object to be printed.

In machines of the foregoing type heretofore available, the biasing means or spring for the inkcup assembly is part of the printing machine, and this adds difficulty and complexity to maintenance operations performed on the inkcup assembly. Furthermore, the biasing means or spring can apply undesirable forces to the machine frame or other components.

In machines of the foregoing type, it is desired to provide the above-described movements of the inkcup assembly and the pad as fast as possible to achieve the shortest possible printing time cycle to maximize productivity. However, increased speed of the inkcup assembly and pad can cause undesirable machine vibration and jamming of components thereof with resultant rapid wear.

It would, therefore, be highly desirable to provide, in a printing machine of the foregoing type, an inkcup assembly which can be removed easily manually from the machine in a sealed, self-contained condition and in which the biasing means or spring thereof does not apply any force to the remainder of the machine. It also would be highly desirable to provide, in a printing machine of the foregoing type, motive means for moving the inkcup assembly and motive means for moving the pad, both of which provide movement as fast as possible wherein the acceleration is as smooth as possible.

SUMMARY OF THE INVENTION

It is, therefore, a principal object of the present invention to provide a new and improved inkcup assembly for a printing machine.

It is a more particular object of this invention to provide such an inkcup assembly wherein the biasing means therefor does not act on components of the machine other than the inkcup assembly.

It is a further object of this invention to provide such an inkcup assembly which is readily removable from the machine by hand in a sealed and contained condition.

It is another principal object of the present invention to provide a new and improved drive means for the inkcup assembly and pad of a printing machine.

It is a more particular object of this invention to provide such drive means which imparts harmonic motion to the inkcup assembly and to the pad of the printing machine.

It is a further object of this invention to provide such drive means which provides the aforesaid harmonic motion with the simplest possible arrangement.

The present invention provides an inking means and motive means for a printing machine including a printing plate having an operative surface provided with an image to receive ink to be transferred to an object to be printed, wherein the inking means is movable along the printing plate operative surface between a inking position over the image and a standby position spaced from the image, and wherein a pad means is movable between a pickup position over the image and a printing position spaced from the image. The inking means comprises a hollow body adapted to contain a supply of ink and having an open end outlined by a wiping edge, biasing means operatively engaging the hollow body for urging the wiping edge into contact with the operative surface of the printing plate, and holding means for supporting the biasing means and operatively engaging the printing plate in a manner such that the assembly of hollow body, biasing means and holding means is movable along the printing plate to place the open end of the hollow body into and out of registry with the image for inking the same and in a manner such that the biasing means is entirely within the inking means and applies force only to the hollow body and to the holding means. The printing plate is removable from the machine so that the inking means is easily manually removable from the machine in a sealed and contained condition. A first motive means moves the inking means between the inking and standby positions in a manner such that the motion imparted to the inking means by the motive means is harmonic in nature wherein the inking means accelerates to reach maximum speed between the inking and standby positions and the inking means decelerates to reach zero speed at the inking and standby positions. A second motive means moves the pad between the pickup and printing positions in a manner such that the motion imparted to the pad means by the motive means is harmonic in nature wherein the pad means accelerates to reach maximum speed between the pickup and printing positions and the pad means decelerates to reach zero speed at the pickup and printing locations. There is also provided fixture means for receiving the printing plate and inking means as a unit when removed from the machine, the fixture means including restraining means operatively contacting the unit to restrain the force of the biasing means to allow manipulative operations on the unit.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 8 is an enlarged side elevational view of the inkcup assembly according to the present invention and included in the machine of FIG. 1;

FIG. 9 is a top plan view of the inkcup assembly of FIG. 8;

FIG. 10 is a sectional view taken about on line 10—10 in FIG. 8;

FIG. 11 is an enlarged fragmentary sectional view illustrating the spring restraining means in the inkcup assembly of FIGS. 9 and 10;

FIGS. 12A, 12B and 12C are diagrammatic views illustrating operation of the cam means and cam follower means of the drive mechanism according to the present invention at various stages in a printing cycle;

FIG. 13 is a graph of linear velocity vs. angular shaft rotation illustrating operation of the mechanism of FIGS. 12A-12C;

FIG. 16 is an end elevational view of the fixture of FIG. 14.

DETAILED DESCRIPTION OF THE ILLUSTRATED EMBODIMENT

Figure 1:
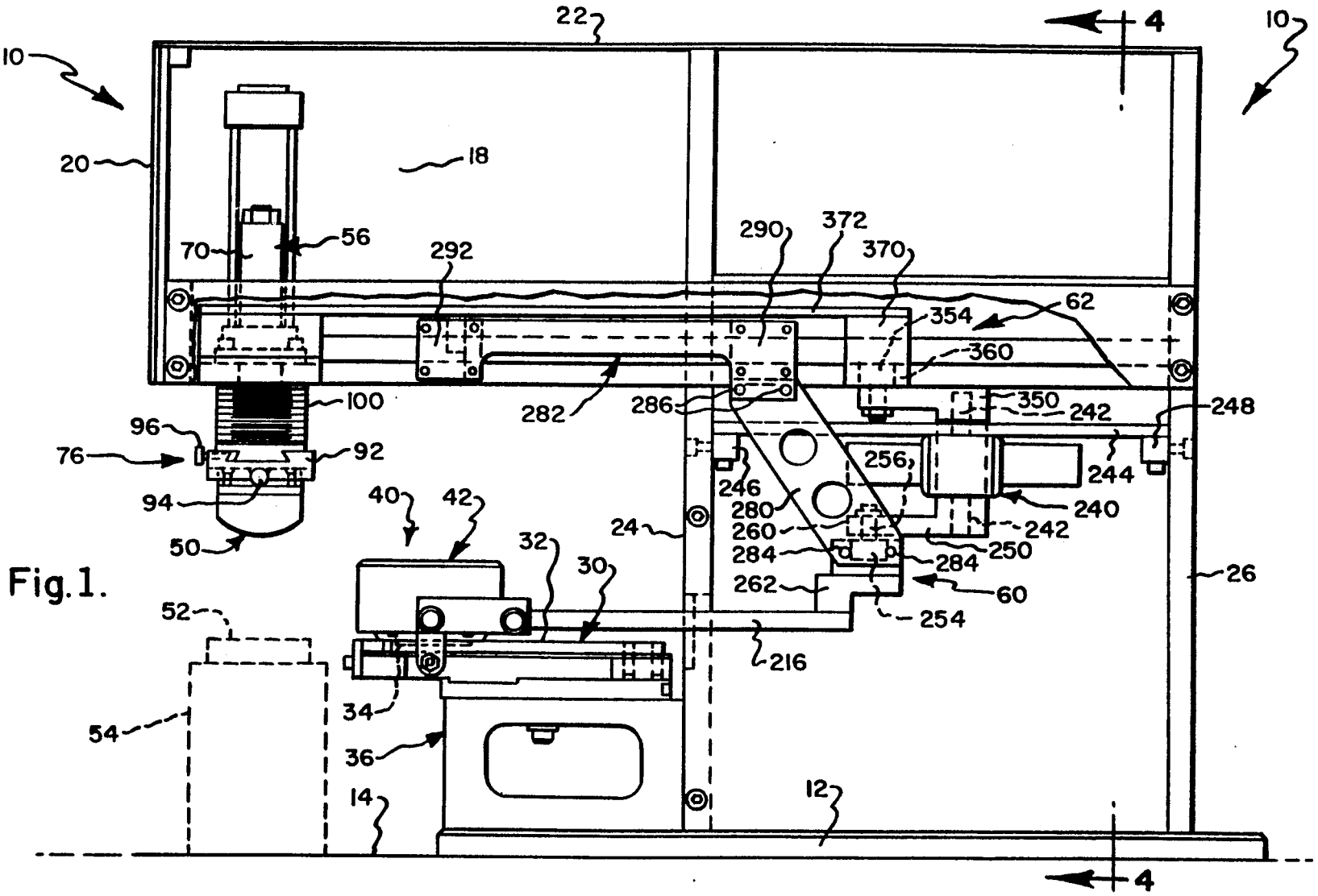
FIG. 1 is a side elevational view with parts removed of a printing machine including the inkcup assembly and drive mechanisms of the present invention.

Referring first to FIGS. 1-4, there is shown a pad-type printing machine generally designated 10 which includes the inkcup assembly and drive mechanism according to the present invention. Machine 10 includes a base 12 adapted to rest on a supporting surface 14 such as the top of a table or the like. A machine frame is supported by the base plate 12 and includes a pair of spaced-apart, mutually parallel side panels 16 and 18 disposed substantially parallel to base 12, a front panel 20 joining the side panels 16,18 and disposed perpendicular thereto and to base 12, a top panel 22 joining side panels 16,18 disposed perpendicular thereto and parallel to base 12 and spaced-apart front and back plates 24 and 26 respectively. Front plate 24 extends from base 12 disposed perpendicular thereto and between side panels 16,18 which are joined thereto, plate 24 being disposed perpendicular to plates 16,18. Similarly, back plate 26 extends from base 12 disposed perpendicular thereto and between side panels 16,18 which are joined thereto, plate 26 being disposed perpendicular to plates 16,18. Back plate 26 is located near one end of base 12, i.e. the right-hand end as viewed in FIG. 1, and front plate 24 is located approximately mid-way between back plates 26 and front panel 20. Various operating components of machine 10 are supported by the frame in a manner which will be described.

Machine 10 includes a printing plate or cliche 30 which is elongated rectangular in shape and has an operative surface 32 provided with an image 34 thereon to receive ink to be transferred to an object to be printed. Image 34 is etched or otherwise formed on surface 32 in a manner well-known to those skilled in the art. Printing plate 30 is adjustably and removably mounted on a mounting arrangement generally designated 36 which is fixed to the machine frame and which will be described in detail presently.

Machine 10 further includes inking means generally designated 40 in the form of an inkcup assembly 42 for applying ink to image 34. To this end inking means 40 is movable along surface 32 of printing plate 30 between an inking position as shown in FIG. 1 over the image 32 and a standby position spaced from image 32, i.e. to the right as viewed in FIG. 1. Such movement of inking means 40 is provided during each printing cycle of machine 10 as will be described in further detail presently. The structure and operation of the inkcup assembly 42 according to the present invention will be described in detail further on in this specification.

Machine 10 further includes pad means generally designated 50 for picking up the inked image from printing plate 30 and transferring it to an object or article to be printed. Such object or article can be of many forms and is indicated in generalized, diagrammatic form at 52 in FIG. 1. Object 52 is supported by a fixture 54 or the like which rests on supporting surface 14. Pad means 50 is movable between a pickup position spaced over image 32 on plate 30 and a printing position spaced from the pickup position and which is shown in FIG. 1. In addition, when pad means 50 is at the pickup and printing positions, it is moved toward and away from image 32 and object 52, respectively, by operation of motive means generally designated 56 and in the form of a pneumatic cylinder which will be described.

In accordance with the present invention, there is provided first motive means generally designated 60 for moving inking means 40 between the inking and standby positions in a manner such that the motion imparted to inking means 40 by motive means 60 is harmonic in nature wherein inking means 40 accelerates to reach maximum speed between the inking and standby positions and inking means 40 decelerates to reach zero speed at the inking and standby positions. The structure and operation of the first motive means 60 will be described in detail presently. There is also provided second motive means generally designated 62 for moving pad means 50 between the pickup and printing positions in a manner such that the motion imparted to pad means 50 by motive means 62 is harmonic in nature wherein pad means 50 accelerates to reach maximum speed between the pickup and printing positions and pad means 50 decelerates to reach zero speed at the pickup and printing positions. The struture and operation of the second motive means 62 will be described in detail presently. The first and second motive means 60 and 62, respectively, comprise the aforementioned drive mechanism of the present invention.

Figure 3:
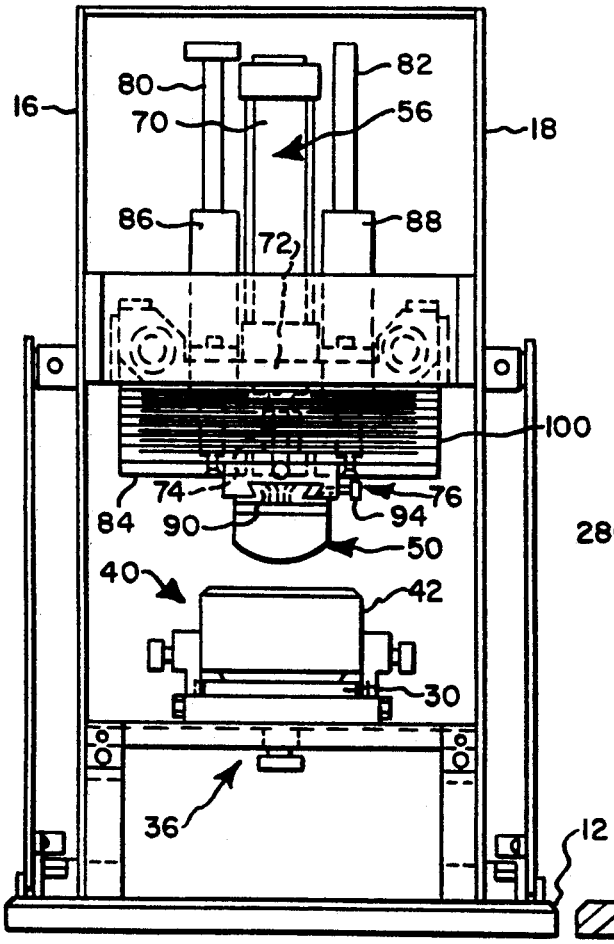
FIG. 3 is a left-hand end elevational view of the machine of FIG. 1.

As shown in FIGS. 1 and 3, the housing 70 of cylinder 56 is mounted in a pad block member 72 which, in turn, is fixed to the machine frame, i.e. to side panels 16,18. The rod 74 of cylinder 56 is connected to a pad assembly generally designated 76. Extension and retraction of rod 74 during operation of cylinder 56 moves the pad assembly 76 including pad means 50 toward and away from image 32 on printing plate 30 and toward and away from object 52 as previously described. Operation of cylinder 56 is automatic under control of a machine controller (not shown) in a manner well-known to those skilled in the art. Movement of pad assembly 76 is guided by a pair of rods 80,82 fixed at one end to an elongated rectangular plate 84 of the pad assembly 76 and extending through a pair of ball bushing housings 86,88 which, in turn, are fixed to pad member 72. Pad means 50 is mounted via a dovetail slot arrangement as shown in FIG. 3 to a first pad adjustment block 90 which, in turn, is mounted via a dovetail slot arrangement as shown in FIG. 1 to a second pad adjustment block 92 which is fixed to plate 84. The dovetail slot arrangements allow positional adjustment of pad means 50 in orthogonal directions which adjustments are maintained by a pair of locking screws 94,96 in a known manner. A protective bellows-like boot 100 of flexible material can be provided between plate 84 and the machine frame as shown in FIGS. 1 and 3.

Figure 5:
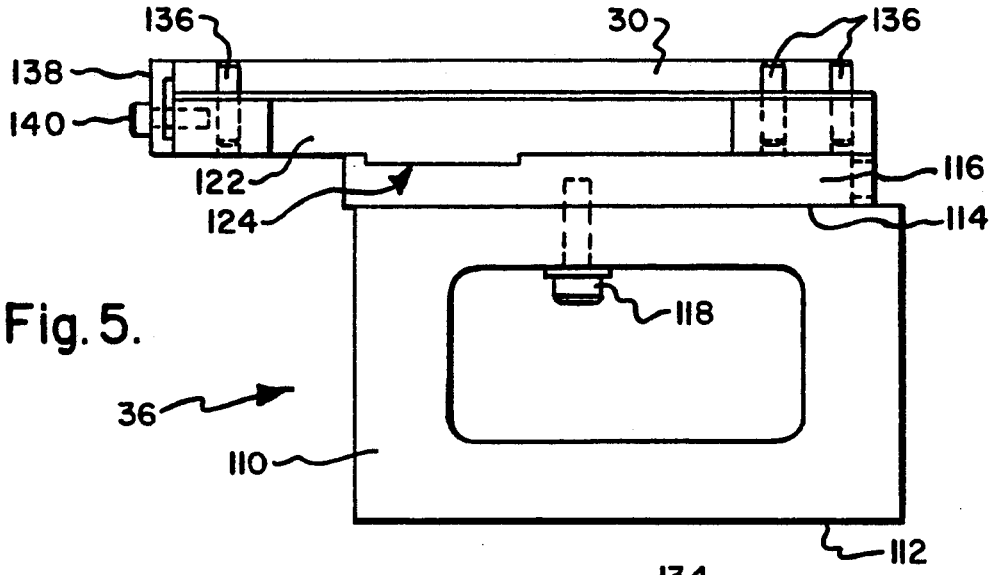
FIG. 5 is an enlarged side elevational view of the printing plate mounting arrangement in the machine of FIG. 1.
Figure 6:
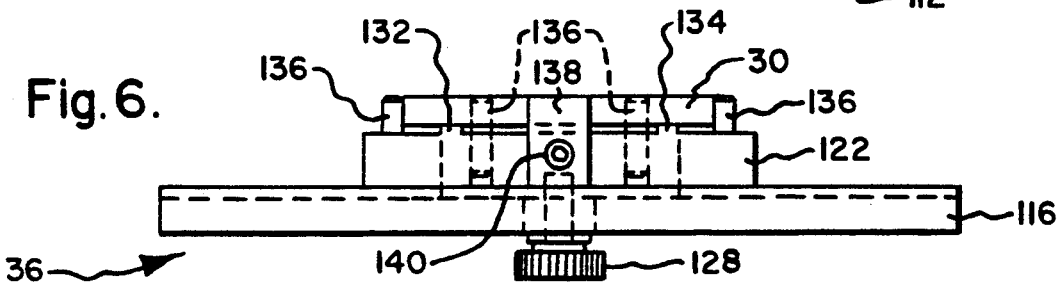
FIG. 6 is an end elevational view of the arrangement of FIG. 5.
Figure 7:
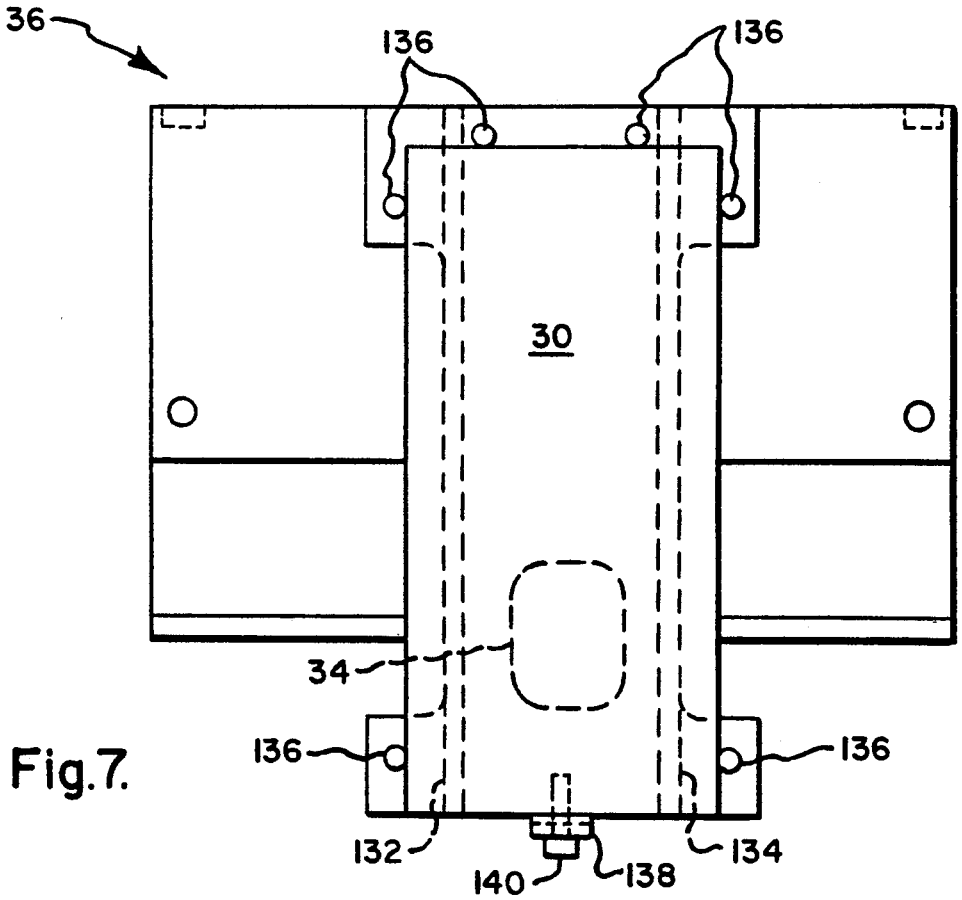
FIG. 7 is a top plan view of the arrangement of FIG. 5.

FIGS. 5–7 show in further detail the arrangement 36 for adjustably and removably mounting printing plate 30. The arrangement includes a support frame member 110 having a bottom surface 112 which rests on base 12 and having a top surface 114 which supports a mounting plate 116. Frame member 110 can also be attached to front plate 24. An adjustment screw 188 connects plate 116 to frame 110, and a slot in frame 110 which receives the shank of screw 118 allows linear adjustment of plate 116 from left to right and vice-versa as viewed in FIG. 5 in a known manner. Plate 116 supports a cliche mounting plate 122, and a tongue and slot-type formation generally designated 124 allows for lateral adjustment of cliche mounting plate 122 on plate 116. A locking screw 128 fixes the lateral position of plate 122 on plate 116. The printing plate or cliche 30 rests on the top surface of plate 122, in particular on a pair of longitudinally extending ribs 132, 134 formed on the plate 122. An arrangement of upstanding guide pins 136 on plate 122 establish the exact location of plate 30 on mounting plate 122. A bracket 138 connected to the end of plate 122 by screw 140 locks plate 30 in position. Loosening of screw 140 and turning of bracket 138 allows printing plate 30 to be removed from the arrangement.

FIGS. 8–11 show in further detail the inkcup assembly 42 according to the present invention. It includes a hollow body 150, generally cylindrical in shape, adapted to contain a supply of ink, and having an open end outlined by a wiping edge 152. In the inkcup shown, edge 152 is the sharp annular edge of a ring member 154 which is fixed to the open end of body 150, such as by engagement between an annular bead 156 on ring 154 and an annular groove 158 in the outer surface of body 150. Ring 154 is made from a hard material, for example carbide metal, inasmuch as edge 152 continually moves along the surface of printing plate 30 during operation of machine 10. As shown in FIGS. 8 and 10, the outer surface of body 150 and ring 154 meet in a manner defining an annular ledge or shoulder, the purpose of which will be described presently. The opposite end of hollow body 150 is closed by a removable cap 164 which is threaded therein and seats on an annular ledge 166 formed in the upper end of body 150 as viewed in FIG. 10.

The inkcup assembly 42 further comprises biasing means in the form of coil spring 170 operatively engaging hollow body 150 for urging the wiping edge 152 into contact with the operative surface 32 of printing plate 30. The inkcup assembly 42 also comprises holding means generally designated 174 for supporting biasing means 170 and operatively engaging printing plate 30 in a manner such that the assembly of hollow body 150, biasing means 170 and holding means 174 is movable along printing plate 130 to place the open end of hollow body 150 into and out of registry with image 32 on plate 30 for inking the same and in a manner such that the biasing means 170 applies force only to hollow body 150 and holding means 174. In particular, holding means 174 includes a first portion 176 which encompasses hollow body 150 and biasing means or spring 170 in a manner such that one end of spring 170 contacts hollow body 150 and the other end of spring 170 contacts portion 176 of holding means 174. Portion 176 is substantially cylindrical having an inner diameter larger than the outer diameter of body 150 by an amount sufficient to define an annular space to receive coil spring 170. One end of spring 170 seats against the shoulder or ledge defined by the junction of the outer surface of body 150 and ring 154. The opposite end of spring 150 seats against an annular lip 180 formed on the inner surface of portion 176. Thus, portion 176 of holding means 174 serves to support or retain the biasing means or spring 170 which is urging the wiping edge 152 into operative contact with surface 32 of printing plate 30. As shown in FIG. 10, hollow body 150, spring 170 and portion 176 of holding means 174 are in substantially concentric relation.

Holding means 174 includes a second portion which operatively movably engages printing plate 30 in a manner which retains the force of biasing means 170 in the combination of inkcup assembly 42 and printing plate 30. Generally speaking, printing plate 30 has another surface and the second portion of holding means 174 includes bearing means movably contacting that other surface. In particular, the second portion of holding means 174 comprises a pair of leg members 184 and 186 which depend from the first portion 176 and which carry a pair of roller bearings 188 and 190, respectively, rotatably connected thereto and which contact the opposite surface 192 of printing plate 30. Roller bearings 188,190 allow smooth sliding movement of inkcup assembly 42 along surface 32 of printing plate 30 while at the same time retaining the force of coil spring 170 in the combination of inkcup assembly 42 and printing plate 30.

Holding means 174 includes a third portion generally designated 200 which provides a removable connection between the first and second portions of holding means 174 and which provides a removable connection between inkcup assembly 42 and its motive means 60. In particular, portion 200 is generally U-shaped including a pair of spaced, generally parallel arm sections 202 and 204 extending from and at substantially right angles to a base section 206. Arm sections 202 and 204 are removably connected to the first portion 176 of holding means 174 by means of a pair of manually operable spring plunger fasteners 210 and 212. Base section 206 is provided with a recess to receive the end of a drive plate 216 which is removably connected thereby by a pair of manually operable spring plunger fasteners 220 and 224. The opposite end of drive plate 216 is connected to motive means 60 in a manner which will be described.

There is also provided means for restraining movement of the end of coil spring means 170 disposed toward printing plate 30 in the event of movement of the encompassing portion 176 of holding means 174 in a direction away from printing plate 30. For example, if during maintenance or other operations on inkcup assembly 42 spring plungers 210 and 212 were removed this would allow holding means portion 176 to be lifted or moved in a direction away from plate 30 with the result that the end of spring 170 could slip over ring 154. This is prevented by the provision of a plurality of pins 230 provided at spaced locations around portion 176 and which are received in recesses 232 provided in ring 154 as shown in more detail in FIG. 11. In addition to preventing the escape of spring 170, the combination of in 230 and recesses 232 prevents relative rotation between ring 154 and portion 176.

Thus, in the inkcup assembly 42 according to the present invention, the biasing means or spring 170 is totally part of the assembly 42. This is in contrast to machines heretofore available wherein the biasing means or spring is part of the machine. The inkcup assembly 42 of the present invention advantageously avoids bending, torquing or stressing of the machine 10 or its frame because spring 170 is totally within assembly 42 and does not apply force to other components of machine 10 or its frame. Furthermore, there is no concern for alignment because spring 170 is not part of machine 10.

Significantly, the inkcup assembly 42 according to the present invention can be easily manually removed from machine 10 without any tools and in a sealed, self-contained condition. One simply removes the spring plungers 220 and 224 to disconnect inkcup assembly 42 from drive plate 216 and manipulates screw 140 and bracket 138 to release printing plate 30. Then inkcup assembly 42 and printing plate 30 are removable from machine 10 as a unit. During such removal, edge 152 is maintained in contact with surface 32 by the co-operation between spring 170 and roller bearings 188,190 so as to retain the ink in hollow body 150. This allows maintenance or ink replenishing operations to be performed efficiently without any mess caused by ink escaping from hollow body 150.

Figure 2:
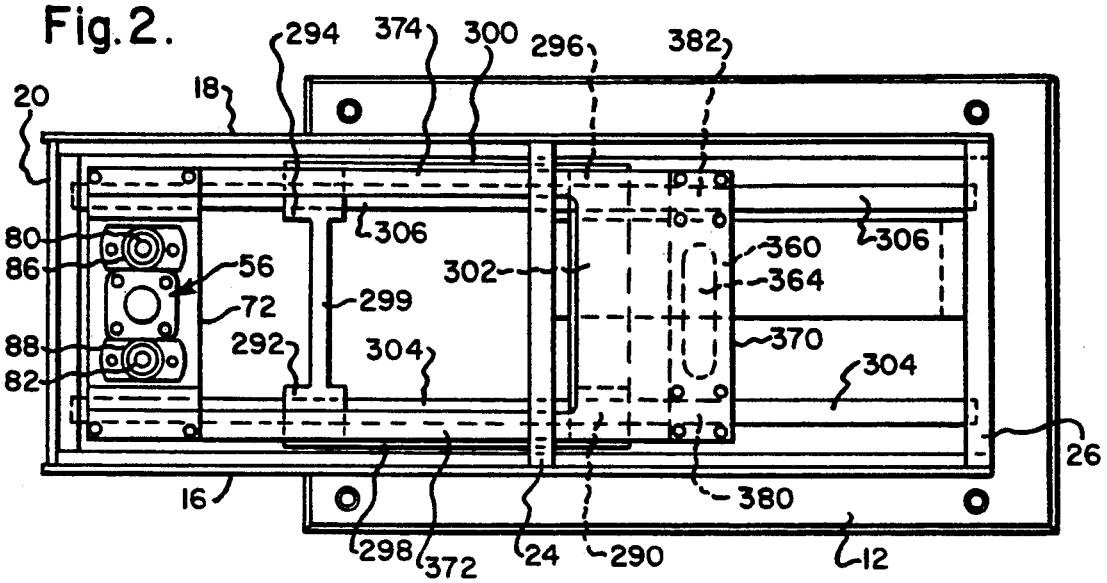
FIG. 2 is a top plan view of the machine of FIG. 1.
Figure 4:
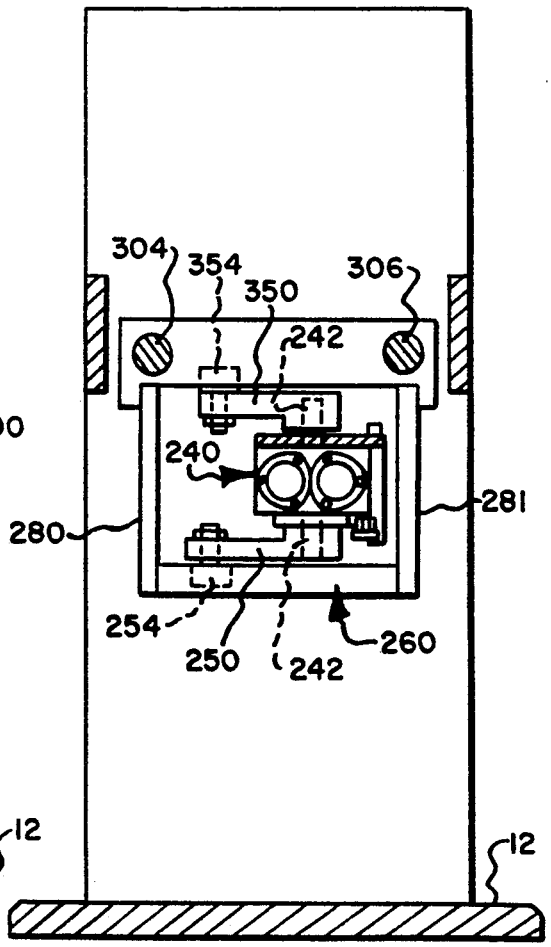
FIG. 4 is a right-hand end elevational view taken about on line 4—4 in FIG. 1.

Referring now to FIGS. 1, 2 and 4 in conjunction with FIGS. 12 and 13 the motive mens 60 and 62 will be described in further detail. Considering first the motive means 60, there is provided drive means generally designated 240 for providing alternating rotary motion. In particular, drive means 240 comprises a rotary actuator wherein the output shaft 242 thereof rotates 180° in one direction and then 180° in the opposite direction, and so on. Rotary actuator 240 is mounted to an actuator mounting pad 244 which, in turn, rests on support bars 246 and 248 which are fixed to the front and back plates 24 and 26, respectively. There is also provided motion converting means coupled to drive means 240 and to inking means 40 for converting the alternating rotary motion of drive means 240 into reciprocating linear motion of inking means 40 in a manner such that the motion of inking means 40 is harmonic in nature. In particular, the motion converting means comprises lever means 250 fixed at one end to shaft 242 of drive means 240 provided with cam follower means in the form of a roller 254 at the opposite end thereof, roller 254 having a shaft 256 rotatably connected to lever arm 250. The motion converting means further comprises cam means 260 connected to inking means 40 and including means defining a cam surface which will be described in detail presently. Cam means 260 is fixed via a connector member 262 to the end of drive plate 216 previously described. In other words, the connection betwen cam means 260 and drive plate 216 is rigid.

Referring now to FIG. 12, cam means 260 is in the form of an elongated rectangular plate-like element having an elongated slot 264 therein which defines the afore-mentioned cam surface. In particular, the elongated slot 264 includes spaced-aart substantially parallel surfaces or edges 266 or 268 which extend substantially parallel to the longitudinal axis of cam means 260 and are spaced-apart a distance substantially equal to the diameter of roller 254 in a manner such that the roller can move readily along slot 264. Slot 264 terminates at opposite ends in curved surfaces 270 and 272.

The longitudinal axis of cam means 260 and thus the surfaces 266,268 and the longitudinal axis of slot 264 all are disposed substantially perpendicular to the direction of linear reciprocating movement of inking means 40 along printing plate 30. The length of slot 264 is substantially equal to the width of driver plate 216 and connector 262 so as to insure a direct transmission of the motion of cam means 260 to inking means 40. Cam means 260 moves back and forth in a direction substantially perpendicular to the longitudinal axis of slot 264 in response to the alternating rotary motion of actuator output shaft 242. Such movement of cam means 260 is guided by the following arrangement.

There is provided a pair of arm members, one designated 280 in FIG. 1, which connect cam means 260 to bearing means generally designated 282 which, in turn, is movably or slidably supported in the machine frame. In particular, the lower end of arm 280 as viewed in FIG. 1 is fastened to the one end of cam means 260 by screws 284. The upper end of arm 280 as viewed in FIG. 1 is fastened to bearing means 282 by screws 286. The other arm 281 joins the opposite end of cam means 260 to the opposite side of bearing means 282 in the same manner. Bearing means 282, also shown in FIG. 2, is in the form of a rectangular structure including four bearing blocks 290, 292, 294 and 296 at each corner of the rectangle and joined by arms 298, 299, 300 and 302. The bearing blocks, in turn, are slidably mounted on a pair of support rods 304, 306 in spaced parallel relation extending longitudinally of machine 10 and connected at the forward end to front panel 20 and connected at the rear end to back plate 26. Thus bearing blocks 290, 292 move along rod 304 and bearing blocks 294, 296 move along rod 306.

FIGS. 12A, 12B and 12C illustrate the manner in which the cam follower means or roller 254 operatively engages the cam surface, i.e. the surfaces or edges 266 or 268 of slot 264 in a manner so as to provide the reciprocating linear motion of inking means 40 which is harmonic in nature. FIG. 12A illustrates the relative positions of roller 254 and slot 264, when inkcup assembly 42 is in the inking position of FIG. 1. Point 310 in FIG. 12 corresponds to the axis of rotary actuator shaft 242. In order to move inkcup assembly 42 to the right in FIG. 1 to the standby position, rotary actuator 240 rotates shaft 242 through an angle of 180°. FIG. 12B shows the relative positions of roller 254 and slot 264 mid-way between the inking and standby positions, and FIG. 12C shows the relative positions of roller 254 and slot 264 when shaft 242 has rotated through 180° and assembly 42 reaches the standby position. During the foregoing operation, cam means 260 moves to the right as viewed in FIG. 1.

The linear velocity of inkcup assembly 42 during the foregoing operation is illustrated by portion 318 in the curve of FIG. 13. The velocity is zero at the inking position corresponding to FIG. 12A, reaches a maximum at the mid-way point corresponding to FIG. 12B and returns to zero at the standby position corresponding to FIG. 12C.

When inkcup assembly 42 is to be returned to the inking position, rotary actuator 240 rotates shaft 242 180° in the opposite direction and the operation proceeds in reverse from FIG. 12C to FIG. 12A with cam means 260 moving to the left as viewed in FIG. 1 and inkcup assembly 42 returning to the position of FIG. 1. The linear velocity of inkcup assembly 42 during this operation is illustrated by portion 324 of the curve of FIG. 13 with the velocity being zero at the standby position of FIG. 12C, reaching a maximum at the mid-way portion of FIG. 12B and reaching zero at the inking position of FIG. 12A.

The two portions 318 and 324 of the curve of FIG. 13 correspond to one printing cycle of machine 10 over the duration indicated by line 328 in FIG. 13. The foregoing is repeated successively as articles are sequentially presented to machine 10 for printing.

From the foregoing it is seen that the linear motion of inkcup assembly 42 is harmonic in nature. This advantageously results in a smooth motion of inkcup assembly 42 avoiding any tilting or tipping thereof and also avoiding undesirable vibration of machine 10 and consequent wear thereof. The arrangement of the present invention providing the foregoing harmonic motion enables the machine cycle to be as fast as possible with acceleration of inkcup assembly being as smooth as possible. Furthermore, the harmonic motion of inkcup assembly 42 advantageously is achieved with a relatively simple mechanism.

Motive means 62 is substantially identical in structure to motive means 60 and operates in an identical manner to move pad means 50 between pickup and printing positions with motion that is harmonic in nature. Shaft 242 of rotary actuator 240 is fixed to one end of a lever 350 identical to lever 250 which is provided with a roller 354 identical to roller 254 which is received in a slot 364 of a cam means 360 identical to cam means 260. Motion of cam means 360, which is identical to the motion of cam means 260, is coupled to pad means 50 by an arrangement including a driver 370 fixed at one end to cam means 360 and having arms 372,374 which extend therefrom and are joined to pad member 72. Bearing blocks 380,382 on driver 370 are slidably supported on rods 304,306 and another pair of bearing blocks (not shown) fixed to pad 72 are also supported by rods 304,306.

Pad means 50 is shown in the printing position in FIG. 1 and the position of cam means 360 and roller 364 is that of FIG. 12A. Movement of pad means 50 from the printing position of FIG. 1 to the pickup position over image 34 is provided by rotation of actuator shaft 242 through 180° and corresponds to FIGS. 12B and 12C and to curve portion 318 in FIG. 13. Return motion of pad means 50 to the printing position of FIG. 1 is provided by rotation of shaft 242 in the opposite direction through 180° and corresponds to proceeding from FIG. 12C through FIG. 12B to FIG. 12A and corresponds to curve portion 320 in Fig. Thus, the reciprocating linear motion of pad means 50 is harmonic in the same manner as that of inkcup assembly 42 and with all of the same advantages.

As shown in FIGS. 12A and 12C, roller 254 does not contact the curved end surfaces 270 and 272 of slot 264 so as to enhance the smoothness of operation. The same is true for roller 354 in relation to slot 364 of cam means 360. By way of example, in an illustrative machine 10, rotary actuator 240 is a BIMBA Pneu Turn rotary actuator model no. PT 074 180 C1DMTD.

Figures 14, 15:
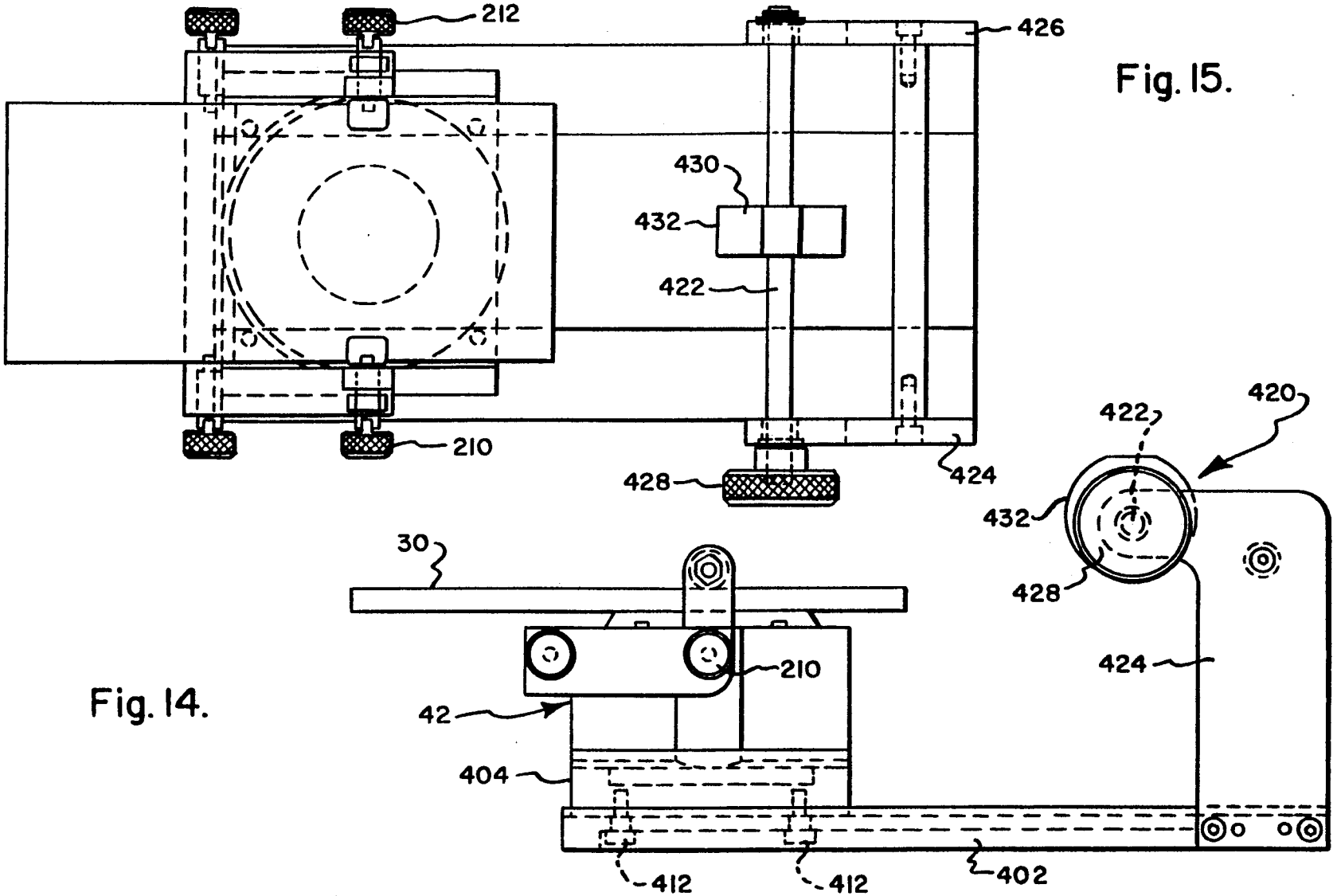
FIG. 14 is a side elevational view of a fixture according to the present invention for receiving the inkcup assembly and printing plate as a unit when removed from the machine of FIG. 1.
FIG. 15 is a top plan view of the fixture of FIG. 14.

FIGS. 14–16 illustrate a fixture generally designated 400 for receiving printing plate 30 and inkcup assembly 42 as a unit when removed from machine 10 as previously described. Fixture means 400 includes restraining means, which will be described, for operatively contacting the unit to restrain the biasing means to allow manipulative operations on the unit, such as maintenance and ink replenishing. In particular, fixture means 400 comprises a base 402 adapted to rest on a supporting surface such as a table top, and includes a component or block 404 slidable lengthwise along base 402, the block 404 including a recess 406 in the top surface thereof adapted to receive the unit in an inverted condition as shown with printing plate 30 spaced upwardly of base 402. Block 404 has a tongue-like formation 408 on the lower surface thereof which is guided along a track 410 formed along the surface of base. Screws 412 fixed in block are received in a slot along base to prevent upward movement of block 404 in a known manner. Fixture 400 further includes restraining means designated 420 which extends from base 402 and is manually operable to be movable into and out of contact with the unit. In particular, a shaft 422 is rotatably supported by a pair of arms 424,426 extending rrom base 402 and is provided with a knob 428 at one end. A disc-like body 430 is fixed mid-way along shaft 422 and is eccentrically mounted thereon. When the unit of inkcup assembly 42 and printing plate 30 is moved by block 404 under body 430, knob 428 is rotated to place the peripheral surface 432 of body 430 into contact with plate 30, forcing it slightly downwardly as viewed in the drawing against the force of the biasing spring. This facilitates removal of the spring plungers 210,212 and manipulation of the other components easily without encountering the effects of the force of the biasing spring.

It is therefore apparent that the present invention accomplishes its intend objects. While an embodiment of the present invention has been described in detail, that is for the purpose of illustration, not limitation.

I claim:

1. In a printing machine including a printing plate having an operative surface provided with an image to receive ink to be transferred to an object to be printed, inking means comprising:

a) a hollow body adapted to contain a supply of ink and having an open end outlined by a wiping edge;

b) biasing means operatively engaging said hollow body for urging said wiping edge into contact with said operative surface of said printing plate; and c) holding means for supporting said biasing means and operatively engaging said printing plate in a manner such that the assembly of hollow body, biasing means and holding means is movable along said printing plate to place said open end of said hollow body into and out of registry with the image for inking the same and in a manner such that said biasing means applies force only to said hollow body and to said holding means.

2. Apparatus according to claim 1, wherein said printing plate has another surface and wherein said holding means includes bearing means movably contacting said other surface.

3. Apparatus according to claim 1, wherein said biasing means comprises spring means having one end operatively contacting said hollow body for applying biasing force toward said operative surface of said printing plate and having another end operatively containing said holding means.

4. Apparatus according to claim 1, wherein said hollow body is substantially cylindrical with the longitudinal axis thereof disposed substantially perpendicular to said operative surface of said printing plate, wherein said biasing means comprises coil spring means encompassing said hollow body in substantially concentric relation with the end of said coil spring disposed toward said printing plate operatively contacting said hollow body, and wherein said holding means includes a portion encompassing said coil spring means and said hollow body in a manner such that the opposite end of said coil spring means operatively contacts said portion of said holding means.

5. Apparatus according to claim 1, further including drive means operatively connected to said inking means for moving said open end of said hollow body into and out of registry with the image.

6. Apparatus according to claim 1, wherein said printing plate has an opposite surface and wherein said holding means includes roller bearing means movably contacting said opposite surface.

7. Apparatus according to claim 1, further including means for releasably mounting said printing plate in said machine so that said printing plate and said inking means can be removed from said machine as a unit.

8. Apparatus according to claim 1, further including pad means for transferring ink from said image to an article to be printed.

9. Apparatus according to claim 4, further including means for restraining movement of the end of said coil spring means disposed toward said printing plate in the event of movement of said encompassing portion of said holding means in a direction away from said printing plate.

10. In a printing machine including a printing plate having an operative surface provided with an image for receiving ink to be transferred to an object to be printed and inking means movable along said surface between an inking position over said image and a standby position spaced from said image:

motive means for moving said inking means between said inking and standby positions in a manner such that the motion imparted to said inking means by said motive means is harmonic in nature wherein said inking means accelerates to reach maximum speed between said inking and standby positions and said inking means decelerates to reach zero speed at said inking and standby positions.

11. Apparatus according to claim 10, wherein said motive means comprises:

a) drive means for providing alternating rotary output motion; and b) motion converting means coupled to said drive means and to said inking means for converting the alternating rotary motion of said drive means into reciprocating linear motion of said inking means in a manner such that the motion of said inking means is harmonic in nature.

12. Apparatus according to claim 11, wherein said motion converting means comprises:

a) lever means fixed at one end to the output of said drive means and provided with cam follower means at the opposite end thereof;

b) cam means connected to said inking means and including means defining a cam surface; and c) said cam follower means operatively engaging said cam surface in a manner so as to provide said reciprocating linear motion of said inking means which is harmonic in nature.

13. Apparatus according to claim 12, wherein said cam means comprises roller means rotatably connected to said lever means and wherein said means defining a cam surface comprises an elongated slot in said cam means receiving said roller means for movement along said slot, said slot having a longitudinal axis disposed substantially perpendicular to the direction of movement of said inking means.

14. In a printing machine including a printing plate having an operative surface provided with an image for receiving ink to be transferred to an object to be printed and including pad means movable between a pickup position over said image and a printing position spaced from said image:

motive means for moving said pad means between said pickup and printing positions in a manner such that the motion imparted to said pad means by said motive means is harmonic in nature wherein said pad means accelerates to reach maximum speed between said pickup and printing positions and said pad means decelerates to reach zero speed at said pickup and printing positions.

15. Apparatus according to claim 14, wherein said motive means comprises:

a) drive means for providing alternating rotary output motion; and b) motion converting means coupled to said drive means and to said pad means for converting the alternating rotary motion of said drive means into reciprocating linear motion of said pad means in a manner such that the motion of said inking means is harmonic in nature.

16. Apparatus according to claim 15, wherein said motion converting means comprises:

a) lever means fixed at one end to the output of said drive means and provided with cam follower means at the opposite end thereof;

b) cam means connected to said pad means and including means defining a cam surface; and c) said cam follower means operatively engaging said cam surface in a manner so as to provide said reciprocating linear motion of said pad means which is harmonic in nature.

17. Apparatus according to claim 16, wherein said cam means comprises roller means rotatably connected to said lever means and wherein said means defining a cam surface comprises an elongated slot in said cam means receiving said roller means for movement along said slot, said slot having a longitudinal axis disposed substantially perpendicular to the direction of movement of said pad means.

18. In a printing machine including a printing plate having an operative surface provided with an image to receive ink to be transferred to an object to be printed, inking means movable along said surface between an inking position over said image and a standby position spaced from said image and pad means movable between a pickup position over said image and a printing position spaced from said image:

a) first motive means for moving said inking means between said inking and standby positions in a manner such that the motion imparted to said inking means by said motive means is harmonic in nature wherein said inking means accelerates to reach maximum speed between said inking and standby positions and said inking means decelerates to reach zero speed at said inking and standby positons; and b) second motive means for moving said pad means between said pickup and printing positions in a manner such that the motion imparted to said pad means by said second motive means is harmonic in nature wherein said pad means accelerates to reach maximum speed between said pickup and printing positions and said pad decelerates to reach zero speed at said pickup and printing positions.

19. Apparatus according to claim 18, wherein said first motive means comprises:

a) drive means for providing alternating rotary output motion; and b) motion converting means coupled to said drive means and to said inking means for converting the alternating rotary motion of said drive means into reciprocating linear motion of said inking means in a manner such that the motion of said inking means is harmonic in nature.

20. Apparatus according to claim 19, wherein said motion converting means comprises:

a) lever means fixed at one end to the output of said drive means and provided with cam follower means at the opposite end thereof;

b) cam means connected to said inking means and including means defining a cam surface; and c) said cam follower means operatively engaging said cam surface in a manner so as to provide said reciprocating linear motion of said inking means which is harmonic in nature.

21. Apparatus according to claim 20, wherein said cam means comprises roller means rotatably connected to said lever means and wherein said means defining a cam surface comprises an elongated slot in said cam means receiving said roller means for movement along said slot, said slot having a longitudinal axis disposed substantially perpendicular to the direction of movement of said inking means.

22. Apparatus according to claim 19, wherein said drive means is common to said first and second motive means.

23. Apparatus according to claim 18, wherein said second motive means comprises:

a) drive means for providing alternating rotary output motion; and b) motion converting means coupled to said drive means and to said pad means for converting the alternating rotary motion of said drive means into reciprocating linear motion of said pad means in a manner such that the motion of said inking means is harmonic in nature.

24. Apparatus according to claim 23, wherein said motion converting means comprises:

a) lever means fixed at one end to the output of said drive means and provided with cam follower means at the opposite end thereof;

b) cam means connected to said pad means and including means defining a cam surface; and c) said cam follower means operatively engaging said cam surface in a manner so as to provide said reciprocating linear motion of said pad means which is harmonic in nature.

25. Apparatus according to claim 24, wherein said cam means comprises roller means rotatably connected to said lever means and wherein said means defining a cam surface comprises an elongated slot in said cam means receiving said roller means for movement along said slot, said slot having a longitudinal axis disposed substantially perpendicular to the direction of movement of said pad means.

26. Apparatus according to claim 23, wherein said drive means is common to said first and second motive means.

27. In combination:

a) an inkcup assembly for a printing machine including a removable printing plate having an operative surface provided with an image to receive ink to be transferred to an object to be printed, said inkcup assembly comprising a hollow body adapted to contain a supply of ink and having an open end outlined by a wiping edge, biasing means operatively engaging said hollow body for urging said wiping edge into contact with said operative surface of said printing plate and holding means for supporting said biasing means and operatively engaging said printing plate in a manner such that the assembly of hollow body, biasing means and holding means is movable along said printing plate to place said open end of said hollow body into and out of registry with the image for inking the same and in a manner such that said biasing means applies force only to said hollow body and to said holding means; and b) fixture means for receiving said printing plate and inkcup assembly as a unit when removed from said machine, said fixture means including restraining means for operatively contacting said unit to restrain the force of said biasing means to allow manipulative operations on said unit.

28. The combination according to claim 27, wherein said fixture means comprises a base for supporting said unit and wherein said restraining means includes manually operable means extending from said base and movable into and out of contact with said unit.

29. The combination according to claim 28, wherein said base is elongated and includes a slidable component for receiving said unit with the inkcup assembly thereof facing said base and with the printing plate thereof disposed in a plane generally parallel to the plane of said base, said slidable component allowing movement of said unit between a receiving location on said base and an operating location on said base wherein said restraining means can contact said printing plate.

30. The combination according to claim 29, wherein said restraining means comprises manually operable shaft means rotatably mounted in spaced relation to said base and disposed so that the axis of rotation of said shaft means is generally parallel to the plane of said base and a disc-like body eccentrically mounted on said shaft means so that upon rotation of said shaft means the circumferential surface of said body is moved into and out of contact with said printing plate.

* * * * *